US008424681B1

(12) United States Patent
Schonhardt et al.

(10) Patent No.: US 8,424,681 B1
(45) Date of Patent: Apr. 23, 2013

(54) PACKAGE BOX FOR SPECIALTY SHINGLES

(75) Inventors: Patrick Schonhardt, Braham, MN (US); Anna C. Amatruda, East Norriton, PA (US); Robert L. Jenkins, HoneyBrook, PA (US); Steven A. Koch, Collegeville, PA (US)

(73) Assignee: CertainTeed Corporation, Valley Forge, PA (US)

( * ) Notice: Subject to any disclaimer, the term of this patent is extended or adjusted under 35 U.S.C. 154(b) by 1605 days.

(21) Appl. No.: 11/612,728

(22) Filed: Dec. 19, 2006

Related U.S. Application Data

(60) Provisional application No. 60/754,847, filed on Dec. 29, 2005.

(51) Int. Cl.
*B65D 85/46* (2006.01)

(52) U.S. Cl.
USPC ..... 206/323; 206/198; 206/510; 229/103.3; 229/117.14

(58) Field of Classification Search ..... 206/323, 206/143, 180, 187, 198, 745, 747, 749, 780, 206/509, 510, 503, 504, 505; 229/103.3, 229/117.14, 117.15, 117.19
See application file for complete search history.

(56) References Cited

U.S. PATENT DOCUMENTS

| | | | | |
|---|---|---|---|---|
| 2,377,520 | A * | 6/1945 | Robinson, Jr. et al. | 229/120.33 |
| 2,713,997 | A * | 7/1955 | Ruckstell | 165/180 |
| 2,850,223 | A * | 9/1958 | Strauss | 229/117.14 |
| 3,385,430 | A * | 5/1968 | Benzon-Petersen | 206/746 |
| 3,474,949 | A * | 10/1969 | Shine | 229/117.13 |
| 4,119,202 | A * | 10/1978 | Roth | 229/117.13 |
| 4,318,470 | A * | 3/1982 | Montealegre | 229/117.14 |
| 4,550,828 | A * | 11/1985 | Baldwin et al. | 206/349 |
| 5,765,684 | A * | 6/1998 | Van Dore et al. | 206/198 |
| 5,848,695 | A * | 12/1998 | Harris et al. | 206/193 |
| 5,979,747 | A * | 11/1999 | Gnadt et al. | 229/117.14 |
| 6,367,627 | B2 | 4/2002 | Freiborg et al. | |
| 6,435,403 | B1 * | 8/2002 | Giblin et al. | 229/117.28 |
| 6,547,126 | B2 | 4/2003 | Freiborg et al. | |
| D515,415 | S * | 2/2006 | Maddock et al. | D9/432 |

* cited by examiner

*Primary Examiner* — J. Gregory Pickett
*Assistant Examiner* — Ernesto Grano
(74) *Attorney, Agent, or Firm* — Paul & Paul

(57) ABSTRACT

A packaging box is provided, for specialty shingles, wherein there are provided multiple compartments of an interior box, for accommodating shingles, with a sleeve disposed thereabout, and with a handle of the box projecting through an upper wall of the sleeve, with there being no bottom wall for the sleeve, to accommodate ready removal of the sleeve from the multiple-compartment box. A projecting handle of an underlying box can be accommodated in an opening of a next overlying box, when the packages are assembled in stacked relation one upon the other, such as in palletized form.

5 Claims, 6 Drawing Sheets

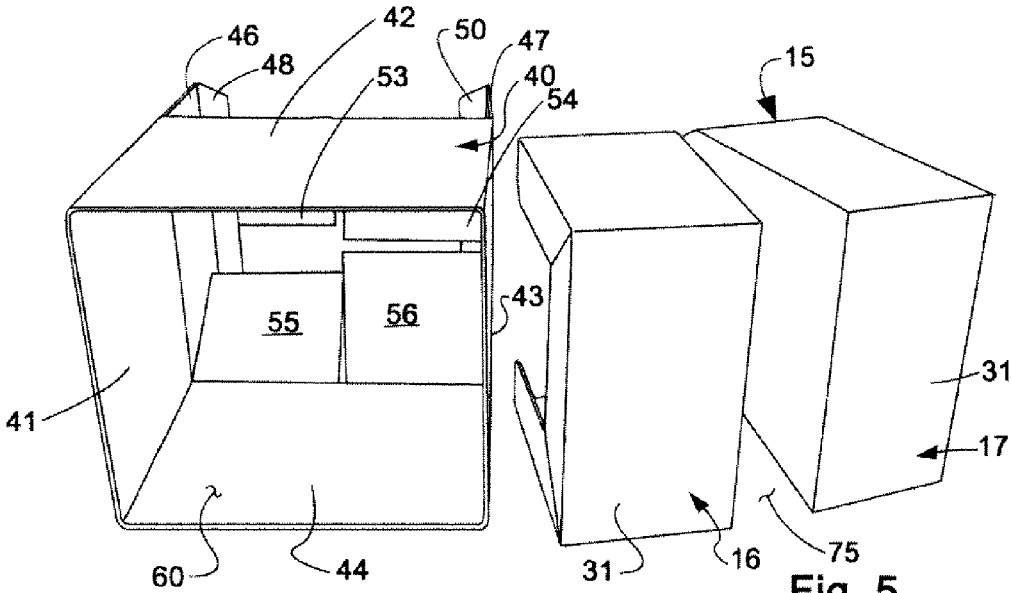
Fig. 6
Fig. 5
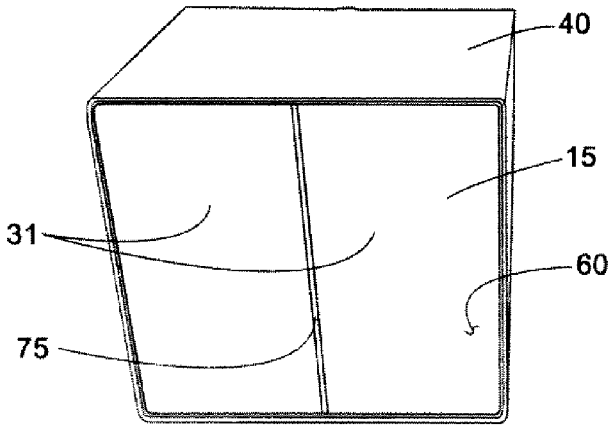
Fig. 7

PACKAGE BOX FOR SPECIALTY SHINGLES

CROSS-REFERENCE TO RELATED APPLICATION

This application claims the benefit of priority from provisional application Ser. No. 60/754,847 filed Dec. 29, 2005.

BACKGROUND OF THE INVENTION

In the art of shingle manufacture, shingles are generally packaged in bundles, with a cardboard kraft paper, a liner layer, or a corrugated paper-based material or like wrapping material disposed about a given number of shingles.

However, aside from the shingles that are conventionally used in roofing, it has become desirable to provide specialty shingles, such as for use along hips, ridges, or rakes of a roof, with such specialty shingles being generally smaller in size than conventional roofing shingles.

In some installations, conventional roofing shingles are cut apart to form smaller shingles that are used on hips, ridges or rakes of a roof. However, the use of such portions of shingles does not provide an appearance that is as ornamental, with a finished look, as can be provided by the use of specialty shingles that are made specifically for the purpose of being used on hips, ridges, and/or rakes of roofs.

It is also sometimes desirable that specialty shingles may have variations in thickness that have to be accommodated in packaging. It is also desirable that sometimes specialty shingles are provided with a three-dimensional aspect, such as being pre-folded or pre-bent to accommodate included angles where there are intersecting surfaces of hips, ridges, and/or rakes of a roof, so that the specialty shingles do not have to be bent or folded at the site of application where, depending upon temperature conditions, they might otherwise develop cracks if they are bent or folded at the site of application.

THE PRESENT INVENTION

The present invention is directed to providing a packaging box for specialty shingles, wherein the packaging box is a two-piece structure, comprising an assembly with an outer sleeve disposed about an inner box. The box in accordance with this invention has two individual compartments that are hingedly connected together. The outer sleeve has an open bottom and is designed to be lifted off the two-compartment box.

Additionally, an upstanding handle may be provided at the location of the hinged connection between the two individual compartments of the box, with the handle protruding up through the top of the outer sleeve, so that the two-piece assembly can be carried via the handle during warehouse loading, at the jobsite or in other situations where the assembly is being carried.

Accordingly, it is a primary object of this invention to provide a two-piece packaging assembly comprising an inner box with two individual components, and an outer sleeve.

It is another object of this invention to provide on the inner two-compartment box, a handle at the point of a hinge connection between the two individual compartments of the box, with the handle protruding upwardly through the top of the outer sleeve, so that the entire two-piece assembly can be lifted for handling.

It is a further object of this invention to provide a two compartment box, constructed as a saddle box, so that the same can be placed over a roof hip or ridgeline, with each half of the saddle box on an opposite side of the apex of a roof hip or ridgeline, with the two halves of the box connected together as a hinged structure, so that the two sides of the saddle box can be adapted to any type of ridgeline or hip structure, to allow placement on any of various slopes or inclines of a roof, to prevent slipping or falling of the box.

Thus, in accordance with the object above, it is a further object of this invention to provide a safety feature for facilitating application of specialty shingles to a roof.

It is a further object of this invention to accomplish the above object, wherein the box of specialty shingles is readily accessible for rapid application and savings of labor via open side access and time in applying specialty shingles to a roof.

It is a further object of this invention to provide a packaging box for specialty shingles, wherein containers of shingles may be readily stacked on a pallet.

It is another object of his invention to accomplish the above object, wherein packaging boxes for specialty shingles can be stacked in nested male/female relation, on a pallet or otherwise, such that a pallet full of such boxes containing specialty shingles may be stable, even when a number of tiers of such boxes are stacked, one above the other, on a pallet.

Other objects and advantages of the present invention will be readily apparent upon a reading of the following brief descriptions of the drawing figures, the detailed descriptions of the preferred embodiments, and the entire disclosure of this invention.

BRIEF DESCRIPTION OF THE DRAWING FIGURES

FIG. 5 is a bottom perspective view of the box of FIG. 2.

FIG. 6 is a bottom perspective view of the outer sleeve of FIG. 3.

FIG. 7 is a bottom perspective view of the assembly of FIG. 4.

DETAILED DESCRIPTIONS OF THE PREFERRED EMBODIMENTS

Figure 1:
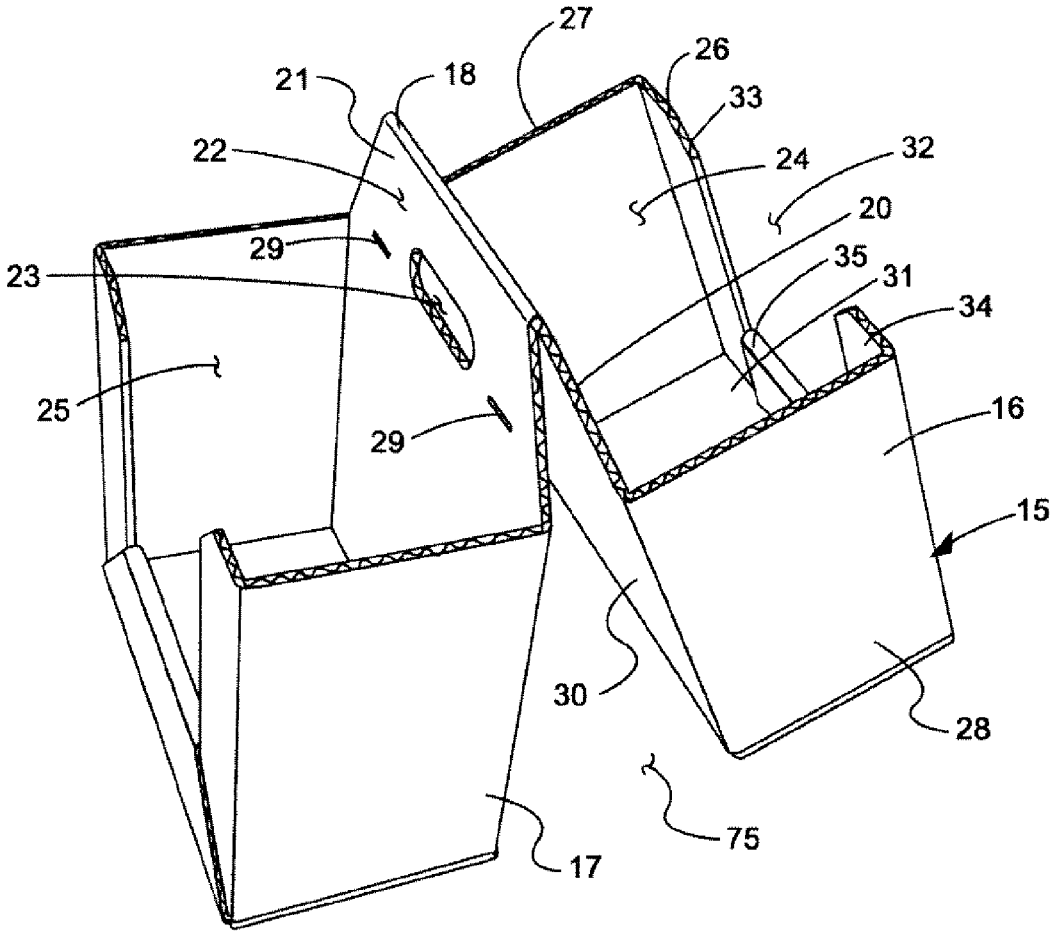
FIG. 1 is a top perspective view of an inner saddle box in accordance with this invention, having two individual compartments connected together in a hinged manner, via a handle, wherein the individual compartments are adapted to receive specialty shingles therein.

Referring now to the drawings in detail, reference is first made to FIG. 1, wherein the inner box 15 is shown, and is constructed as a saddle box having two individual components 16 and 17, hingedly connected at 18, with the two components 16 and 17, being joined by upstanding handle portions 20 and 21, connected via hinge 18 to form a handle that is generally designated at 22, to have a handle opening 23 therein, for accommodating the hand of a user.

Each of the halves or components 16 and 17 of the box 15 has a compartment 24, 25, for accommodating accessory shingles therein, and are similarity constructed, so only box half 16 will be described herein in further detail. The box half 16 includes a front wall 26, end walls 27 and 28, a rear wall 30 and a bottom wall 31.]

The front wall 26 has an access opening 32, for providing ready access to shingles disposed therein, for removing shingles via the access opening 32, as desired. This leaves the front wall 26 of the box half 16 as comprising upstanding side portions 33 and 34, and a bottom portion 35, having a folded-over portion as shown in FIG. 1, using material from the front wall 26 that is available when the access opening 32 is cut away, as shown.

The box of FIG. 1 may be constructed of corrugated cardboard, or other type of cardboard, or the like, and it may be coated or uncoated, or constructed of a wood fiber or layered paper-like material either of solid or hollow design. The materials of construction can include, but are not limited to, recycled or virgin plastic, polyester, PVC or similar materials, or fabric or thin gauge lightweight metal, foam-like material, or even air cushioned or any reasonably stiff or board-like material, as may be desired. The materials of construction may optionally include reinforcing filaments of glass or polyester or other suitable filamentous composition in strands, bundles, tapes or other arrangements.

Figures 2, 3:
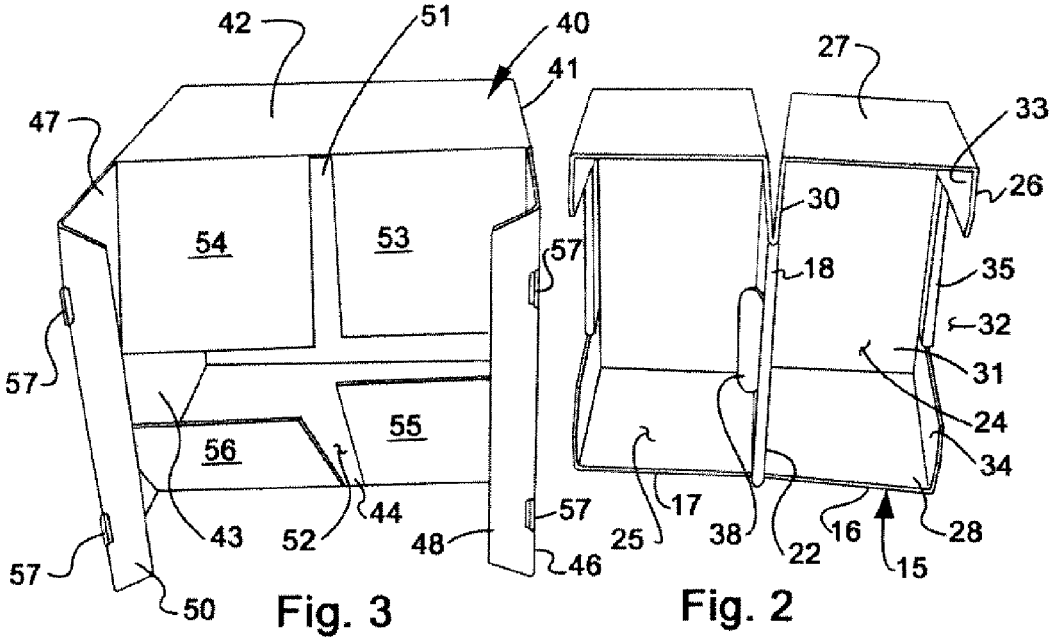
FIG. 2 is a top perspective view of the box of FIG. 1.
FIG. 3 is a top perspective view of an outer sleeve, for disposition about the saddle box of FIG. 2.

With reference now to FIG. 2, it will be seen that the handle 22, with the opposed box halves 16 and 17, being foldably connected at 18 as described above, also has a hingedly connected handle flap cutout 38 as shown, which can be moved hingedly out of the way to accommodate the hand of a user for lifting the box 15. Flap cutout 38 can also provide a gripping aid or hand support for carrying the box.

With reference to FIG. 3, it will be seen that the outer sleeve 40 is comprised of four sidewalls 41, 42, 43 and 44 and a top wall 45 that is comprised of two top wall halves 46, 47, foldably connected to sidewalls 41 and 43, respectively, having locking flaps 48, 50, respectively, for being folded inwardly into slots 51, 52 between four top wall flaps 53, 54, 55 and 56, that in turn, are foldably connected to sidewalls 42 and 44, as shown.

Figure 4:
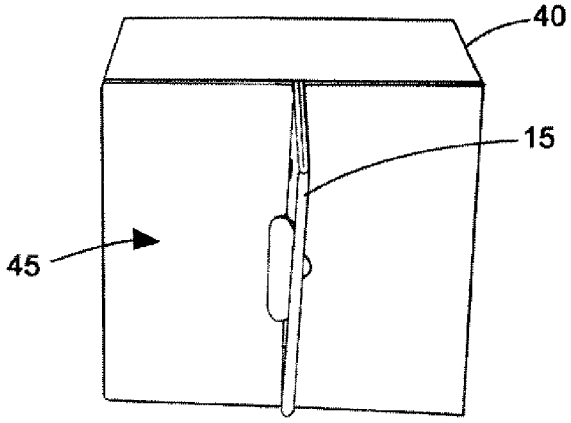
FIG. 4 is a top perspective view of the outer sleeve of FIG. 3 disposed about the box of FIG. 2.

The flaps 48, 50, each have a pair of locking protrusions 57, adapted to be received within lock slots 29 as shown in FIG. 1, when the top halves 46, 47 of the sleeve top 45 are folded down flat, in the manner illustrated in FIG. 4, closing the top of the package sleeve 40.

Figure 8:
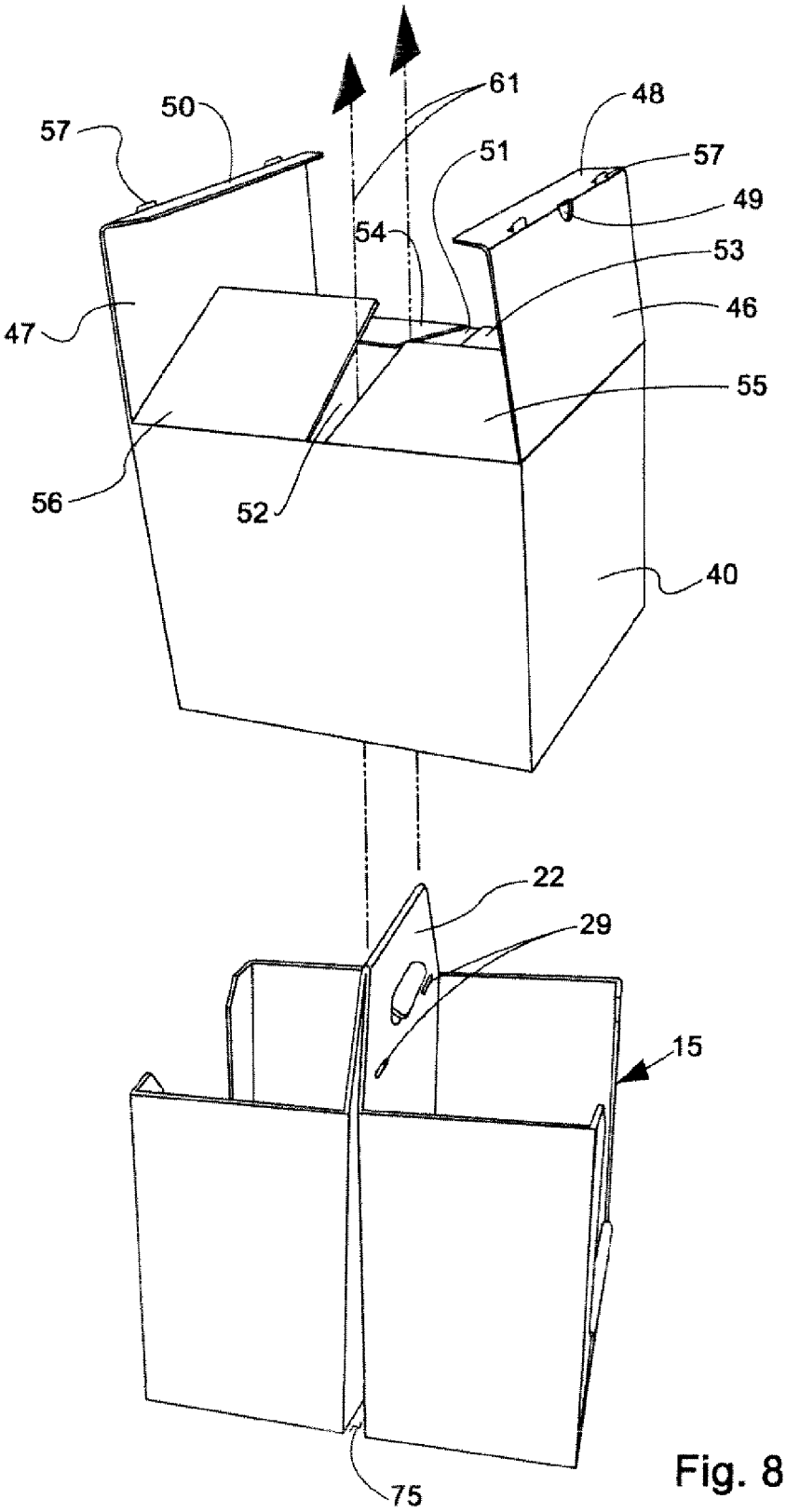
FIG. 8 is an exploded perspective view of the outer sleeve of FIGS. 3 and 6 being removed from its disposition about the box of FIGS. 1.2 and 5.

With reference to FIGS. 2, 3 and 5-7, it will be seen that the sleeve 40, when disposed about the box 15, does not cover the bottoms 31 of the box halves 16, 17, in that the sleeve 40 has an open bottom 60, to accommodate it readily being lifted up from the box 15, as shown in FIG. 8, in telescopic fashion when the sleeve 40 is moved upwardly in the vertical direction as indicted by the arrows 61 in FIG. 8. Such upward lifting of the sleeve 40 is made possible in that the top halves 46, 47 of the sleeve 40 are opened as shown in FIG. 8, to remove the flaps 48, 50 from the slots 51, 52 between top sleeve flaps 53, 54, 55 and 56. It will further be apparent that the locking protrusions 57 as shown in FIG. 8 have been removed from the slotted openings 29 for the box 15 of FIG. 8, in the disposition of the sleeve 40 as shown in FIG. 8, enabling the sleeve 40 to be lifted over the handle 22.

Figure 9:
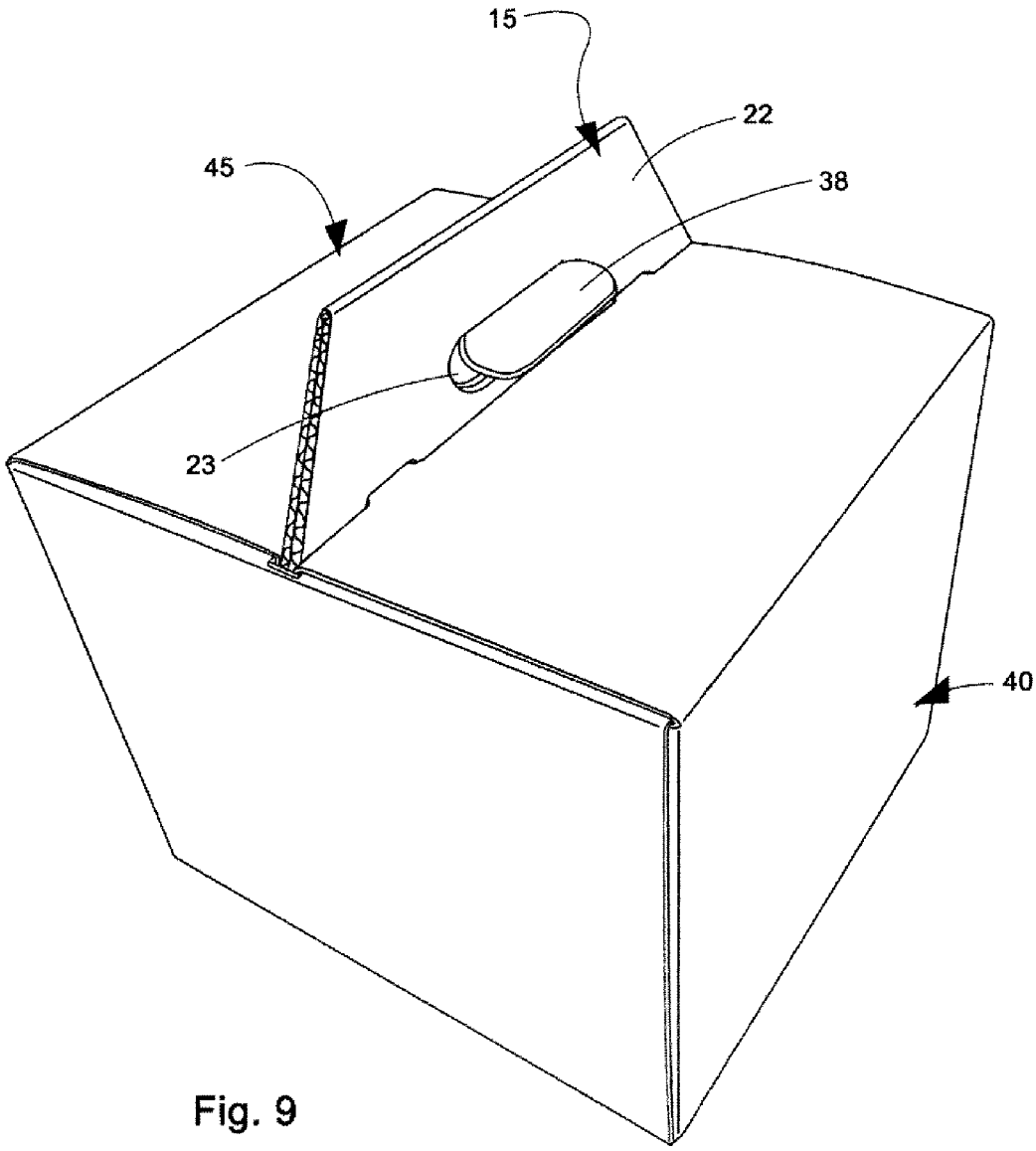
FIG. 9 is a top perspective view of the assembled two-piece package of FIG. 4.

With reference to FIG. 9, the completed packaging box of FIG. 4 is shown in its completed form, which may have accessory shingles mounted in the two compartments (not shown in FIG. 9) of the box 15, with the handle 22 protruding through the top of the sleeve 40.

Figure 10:
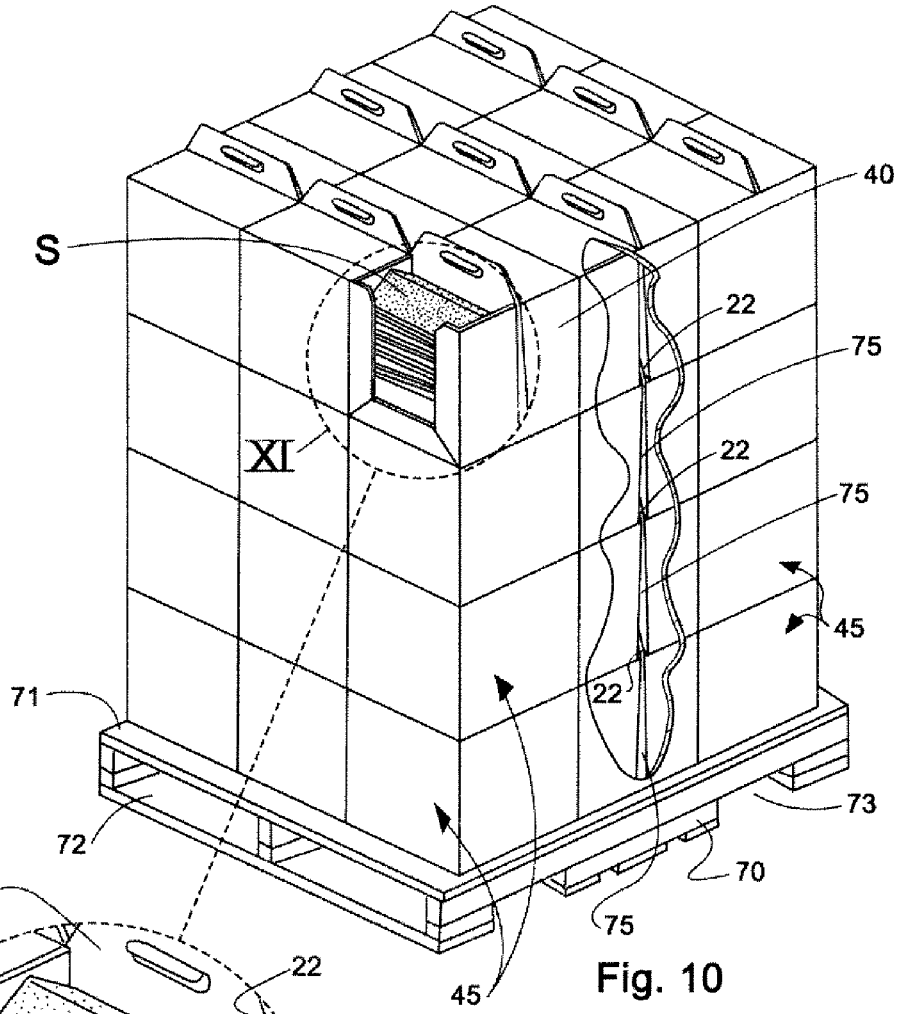
FIG. 10 is a top perspective view of a plurality of two-piece packages of FIG. 9, stacked on a pallet, with a portion of the outer sleeves on the right side of FIG. 10 being broken away as a drafting expedient, to illustrate the male/female nesting of handles of lower boxes in the openings between the two compartments of the saddle boxes disposed thereabove.

With reference now to FIG. 10, it will be seen that a plurality of packaging boxes 45, as shown in FIG. 9, are stacked on a pallet 70. The pallet 70 may be of any conventional construction, such as of the type having an upper surface 71, with a plurality of openings 72, 73 therein, to accommodate the forks of a fork-lift truck or the like, for simultaneously lifting a full pallet of packaging boxes 45 that are mounted thereon.

Figure 11:
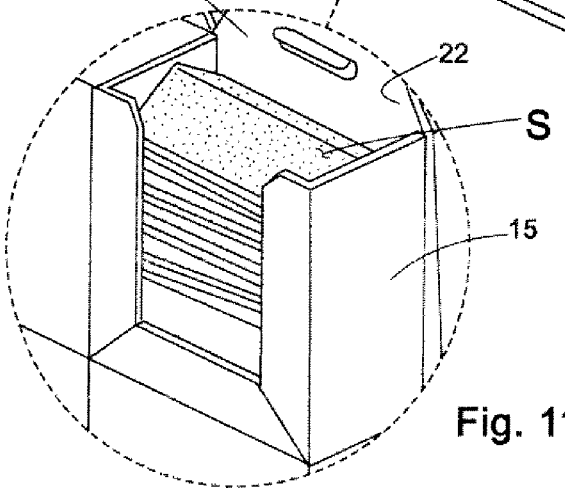
FIG. 11 is an enlarged detail view of one of the compartments of a two-compartment saddle box of FIG. 1, with a portion of the sleeve removed therefrom as a drafting expedient, to illustrate specialty shingles packaged in the box, taken from the zone XI of FIG. 10.

With reference to the detail XI, as shown in FIG. 11, in somewhat enlarged form, it will be seen that a plurality of shingles, such as, for example, those of the hip, ridge or rake type "S" are shown, in stacked relation in one of the compartments 24 on one side of the box 15, although it will be understood that usually both compartments 24, 25 of a box such as that 15 will likely have shingles "S" stacked therein. It will further be understood that the detail illustration of FIG. 11 shows a portion of the sleeve 40 removed therefrom, in order to illustrate, as a drafting expedient, the manner in which shingles "S" are stored within a compartment 24 of the box 15.

Also, with reference to FIGS. 1, 5, 7, 8 and 10 it will be seen that, between the box halves 16, 17, there is provided an opening 75 where the rear walls 20 of the halves 16, 17 of the box 15 come together. In the stacked firm for the packages 45, it will be seen that the projecting handles 22 of boxes 15, of underlying packages 45, project upwardly and fit within the openings 75 of boxes 15 of next-overlying containers 45, in male/female relation, in order to provide a locking together of upper and lower boxes in different tiers when stacked, as for example, on a pallet such as is illustrated in FIG. 10, in order to provide stability to stacked boxes 45 when stacked in palletized or other manner.

It will be apparent from the forgoing that various modifications may be made in the details of construction, as well as in the use and operation of the packaging boxes in accordance with this invention. The materials of construction for the sleeve 40 may, for example, be of the same types as indicated above for the two-compartment boxes 15, or the sleeves may be constructed of any other desirable materials.

Thus the invention provides a unique and innovative packaging design for ease of handling, accessibility, storage and use of specialty roofing material, or other variable thickness accessories, both at ground level, and on inclined surfaces of a roof. The individual saddle boxes allow the packaging of specialty roofing materials therein, to maintain pre-folded or pre-bent angles once they are inserted into the box, although such specialty shingles, could, if desired, be laid flat in the separate components of the boxes, if desired.

It will also be apparent that in accordance with this invention, the hinged handle allows for ready and easy carrying of the box on either a level or inclined surface, or up a ladder, so that a worker can carry a package of shingles with one hand, leaving the other hand free for other uses, such as for grasping a ladder in ascending to a roof. In the stacked or palletized form, the packaging boxes of this invention allow for sufficient rigidity and stiffness, to minimize deformation of the box assemblies under reasonable weight when stacked and the interlocking of the handle of an underlying box, between compartments of a next-overlying box, provides an interlock for stability in stacking of boxes. Also, the interlock of projecting tabs 57, in slotted openings 29 when the sleeves are disposed about the boxes as shown in FIG. 9, accommodates a lower cost for the packaging, because tape, packaging staples or glue is not necessary to secure the package together, but at the same time, easy opening of the tops of the sleeves to remove the sleeves from the box as shown in FIG. 8 is possible. In opening the top wall halves 46, 47, of sleeves 40, the finger access openings 49 facilitate the easy opening of the top halves of the sleeve, for removal of the sleeve from the box.

What is claimed is:

1. A combination container for containing specialty shingles including a box and a sleeve, (a) with the box being a two compartment box, wherein each compartment comprises a back wall, sidewalls, a front wall and a bottom wall, wherein the back walls of each compartment are hingedly connected to each other and are adapted to be disposed back-to-back relative to each other and with their front walls adapted to be spaced apart from each other;

(b) wherein protruding portions of the back walls of each compartment extend upwardly beyond the front wall and sidewalls of each compartment and wherein the hinged connection of the back walls is only at upper ends of said back walls, leaving the two compartments of the box to function as a saddle box means for separation from each other except at the hinged connection, to fit over opposite sides of an apex of a roof structure upon removal of said sleeve;

(c) including a handle opening in the protruding portions of the back walls;

(d) wherein the front walls have openings therein defined by portions of the front walls, for providing visibility to shingles when shingles are disposed therein with the sleeve having four sides, with two opposed sides of the sleeve adapted for engaging the outsides of the two front walls of the box when the box is disposed with its back walls back-to-back to each other with the sleeve disposed therearound, and with the other two opposed sides of the sleeve adapted for engaging the outsides of the sidewalls of the box when the box is disposed with its back walls back-to-back to each other with the sleeve therearound, comprising means for holding the back walls of each compartment of the two compartment box together, against separation from each other, when the sleeve is disposed around the box.

2. The combination container of claim 1, wherein the sleeve has closeable top wall panels foldably carried by sidewalls of the sleeve to form a closed top for the sleeve, and an open bottom for the sleeve, for receiving the box therein.

3. The combination container of claim 2, wherein the closed top for the sleeve has a slotted opening therein for receiving the protruding portions of the back walls of each compartment therethrough when the sleeve is disposed about the box.

4. A package comprising the combination container of any one of claims 1-3, with a plurality of shingles disposed in each compartment of the box.

5. The combination container of claim 3, wherein a plurality of said combination containers are nested together, one on top of another, with protruding portions of back walls of a lowermost combination container being received between back-to-back back walls of a box of a next-overlying combination container.

* * * * *